US011441300B2

(12) United States Patent
Preisig et al.

(10) Patent No.: US 11,441,300 B2
(45) Date of Patent: Sep. 13, 2022

(54) DRAIN ASSEMBLY

(71) Applicant: GEBERIT INTERNATIONAL AG, Jona (CH)

(72) Inventors: Felix Imo Preisig, Uerikon (CH); Marco Oberholzer, Eschenbach (CH); Michael Schintler, Pfäffikon (CH)

(73) Assignee: GEBERIT INTERNATIONAL AG, Jona (CH)

( * ) Notice: Subject to any disclaimer, the term of this patent is extended or adjusted under 35 U.S.C. 154(b) by 12 days.

(21) Appl. No.: 17/042,492

(22) PCT Filed: Mar. 28, 2019

(86) PCT No.: PCT/EP2019/057890

§ 371 (c)(1),
(2) Date: Sep. 28, 2020

(87) PCT Pub. No.: WO2019/185814

PCT Pub. Date: Oct. 3, 2019

(65) Prior Publication Data

US 2021/0010252 A1 Jan. 14, 2021

(30) Foreign Application Priority Data

Mar. 29, 2018 (EP) ..... 18164985

(51) Int. Cl.
*E03C 1/23* (2006.01)
*E03C 1/232* (2006.01)

(52) U.S. Cl.
CPC ..... *E03C 1/2304* (2013.01); *E03C 1/232* (2013.01)

(58) Field of Classification Search
CPC ..... E03C 1/2304; E03C 1/232
USPC ..... 4/682, 683, 688
See application file for complete search history.

(56) References Cited

U.S. PATENT DOCUMENTS 4,594,738 A * 6/1986 Gebert ..... E03C 1/232 251/294
2017/0306598 A1 10/2017 McAlpine

FOREIGN PATENT DOCUMENTS

DE 1840394 U 10/1961
DE 20 2015 107 000 U1 1/2016
EP 1593784 A2 * 11/2005 ..... E03C 1/232
EP 2868816 A1 5/2015
(Continued)

OTHER PUBLICATIONS

International Search Report for PCT/EP2019/057890, dated Jun. 3, 2019.

*Primary Examiner* — Tuan N Nguyen
(74) *Attorney, Agent, or Firm* — Sughrue Mion, PLLC

(57) ABSTRACT

A drain assembly for connection to a sanitary-appliance, comprising: a drain pipe having a pipe inlet and a pipe outlet and a valve arranged in a valve section of the drain pipe having a sealing face and a valve body, wherein the valve body can be moved away from the sealing face from a closed to an open position by an actuating element. Also included is an overflow pipe, which extends away from the drain tube from a first branch lying upstream of the valve seen in the direction of flow of the water to a second branch lying downstream of the valve seen in the direction of flow and thereby bridges the valve. The valve body is at least partially mounted on an insert element; the drain pipe has an insert receptacle; and the insert element can be inserted into the insert receptacle on the drain pipe.

45 Claims, 9 Drawing Sheets

(56) References Cited

FOREIGN PATENT DOCUMENTS

| | | | | |
|---|---|---|---|---|
| FR | 3032732 | A1 * | 8/2016 | ..... E03C 1/2304 |
| WO | 2007/086736 | A2 | 8/2007 | |

* cited by examiner

DRAIN ASSEMBLY

CROSS REFERENCE TO RELATED APPLICATIONS

This application is a National Stage of International Application No. PCT/EP2019/057890 filed Mar. 28, 2019, claiming priority based on European Patent Application No. 18164985.6 filed Mar. 29, 2018.

TECHNICAL FIELD

The present invention relates to a drain assembly in accordance with the preamble of claim 1.

PRIOR ART

EP 0 342 723 has disclosed a drain assembly in which an overflow pipe is arranged above a valve and provides bridging of the valve if the water level in a washbasin rises too far. In this case, the valve can be raised in the vertical. The disadvantage with the drain assembly of EP 0 342 723 is that, owing to the design of the drain assembly, a relatively large amount of installation space is required below the washstand.

Moreover, there is a constant flow of water over the seal which seals the valve on the valve seat when the valve is open, and this is disadvantageous in respect of the life of said seal.

DESCRIPTION OF THE INVENTION

Starting from this prior art, it is an underlying object of the invention to specify a drain assembly which overcomes the disadvantages of the prior art. In particular, the drain assembly should be of more compact design. As a particular preference, the drain assembly should be better for assembly.

This object is achieved by the subject matter of claim 1. Accordingly, a drain assembly for connection to a sanitary item comprises a drain pipe with a pipe inlet and a pipe outlet, a valve, which is arranged in a valve portion of the drain pipe and which has a sealing face and a valve body, wherein the valve body is movable away from the sealing face from a closure position to an open position by means of an actuating element, and an overflow pipe, which extends away from the drain pipe from a first branch point, which is arranged upstream of the valve when viewed in the direction of flow of the water, to a second branch point, which is arranged downstream of the valve in the direction of flow of the water, and thus bridges the valve. In the installed position, the overflow pipe extends substantially upward counter to the plumbline direction. The valve body is mounted at least partially on an insert element. The drain pipe has an insert receptacle, wherein the insert element can be inserted into the insert receptacle on the drain pipe.

Arranging the valve body on an insert element has the advantage that the mounting and removal of the valve body is simplified.

The expression "that the valve body is mounted at least partially on an insert element" should be interpreted to mean that the valve body is mounted completely on the insert element or that the valve body is mounted partially on the insert element and partially on some other element of the assembly.

Here, the mounting is such that the valve body can move relative to the sealing face.

As a particular preference, the mounting of the valve body on the insert element is such that the valve body can be inserted together with the insert element into the drain pipe during an assembly process. The mounting process comprises both mounting and removal. During removal, there is the advantage that, by virtue of the mounting of the valve body on the insert element, the valve body can be removed together with the insert element from the insert receptacle. It is thereby possible to provide easy access to the insert element. This is advantageous particularly if the valve body or parts secured thereon have to be cleaned or exchanged.

A further pipe, which is connected to the sanitary item, can be connected to the pipe inlet. A further pipe, which is connected to the wastewater system, can be connected to the pipe outlet.

The valve body is preferably a valve flap. The sealing face is preferably provided by the drain pipe or by the insert element, wherein the valve flap can be pivoted about a geometric pivoting axis relative to the sealing face. The valve flap is mounted at least partially on the insert receptacle and interacts with the sealing face, which is on the drain pipe.

The design of the valve body as a valve flap has the advantage that simple control and actuation of the valve body is made possible.

The valve flap is mounted on a bearing axle, which is mounted so as to be pivotable about the geometric pivoting axis. The bearing axle is mounted pivotably in a bearing point, in particular in a bearing opening, on the insert element, and/or in a bearing point, in particular in a bearing opening, on the drain pipe. Furthermore, the bearing axle has a free end, which can be actuated by means of said actuating element.

If the bearing point is a bearing opening, a seal is preferably arranged between the bearing axle and the bearing opening, in particular in the end region of the bearing opening. By means of the seal, it is possible to prevent water from accidentally escaping from the pipe section.

The free end is preferably part of a lever arm, which projects from the bearing axle at an angle, in particular at a right angle, wherein the actuating element acts on the free end.

The free end is preferably situated outside the drain pipe and can be actuated from outside the drain pipe. That is to say that the actuating element can likewise be arranged outside the pipe section.

As viewed in the installed position, the geometric pivoting axis or bearing axle preferably extends on the upper side in the drain pipe. By virtue of the arrangement of the pivoting axis on the upper side, there is the advantage that, in the open position, the valve flap is not overflowed by the water flowing through the valve portion. This ensures that the flow of water is not disrupted by the valve flap, increasing the outflow rate. In this case, the flow preferably fills no more than 50% of the cross section of the valve portion.

In the installed position, the pivoting axis or bearing axle is preferably oriented in the horizontal.

It is furthermore preferred that the pivoting axis is situated downstream of the sealing face when viewed in the direction of flow of the water. Thus, the pivoting axis is not in the water when the valve flap is in the closure position. In this regard, the valve flap preferably has an offset region, which keeps the actual flap at a distance from the bearing axle.

In the open position, the valve body is preferably substantially or significantly above the central axis of the valve portion and of the drain pipe.

A return element preferably acts on the valve body, which return element holds the valve body in the closure position thereof. The return element is preferably mounted on the insert element. The return element is preferably arranged outside the water-bearing region of the drain pipe. As a particular preference, the return element is a leaf spring which acts on the bearing axle.

As a particular preference, the valve flap, in the open position thereof, comes to rest in the region in which the branch point opens into the valve portion. In this case, however, the valve flap does not completely close the region of opening, and therefore, as before, a reliable overflow can be provided by the overflow pipe in the event of blockage of the valve flap by foreign matters.

The insert element preferably has a circular-cylindrical bearing portion, and the insert receptacle has a circular-cylindrical bearing receptacle portion, a seal element is arranged between the bearing portion and the bearing receptacle portion. By means of the seal element, a seal is created between the insert element and the insert receptacle, thus preventing any water from escaping from the drain pipe there. The circular-cylindrical design has the advantage that assembly and also sealing can be made very simple.

An orientation structure is preferably arranged between the insert element and the insert receptacle, which structure aligns the insert receptacle, with the valve body mounted in the insert receptacle, relative to the sealing face. By virtue of the arrangement of the orientation structure, the insert element can be placed in the correct position in the insert receptacle.

Positioning in the correct position is advantageous because the valve body is then likewise arranged in the correct position.

The insert element preferably comprises a retaining element, which secures the insert element with respect to the drain pipe after the insertion of the insert element into the insert receptacle. The retaining element is preferably a purely mechanical retaining element which does not have a sealing function.

The retaining element is preferably a cap, which is mounted rotatably on the insert element and which has a thread, which interacts with a thread of corresponding design on the drain pipe. The cap is preferably mounted loosely for rotation on the insert element. As a particular preference, the cap has a circumferential groove in which a ridge of the insert element engages.

In another variant, the retaining element is formed integrally on the insert element and, for example, has the form of a bayonet catch.

In a first embodiment, the insert receptacle opens into the drain pipe between the first branch point and the second branch point. The insert receptacle is preferably oriented in such a way that the insert element can be inserted into the insert receptacle in the direction of an insertion direction transverse to the sealing face. In the installed position, the insertion direction is preferably in the horizontal direction. The insertion direction is preferably parallel to the orientation of the pivoting axis.

In a second embodiment, the insert receptacle opens into the drain pipe between the second branch point and the pipe outlet. The insert receptacle is preferably oriented in such a way that the insert element can be inserted into the insert receptacle in the direction of an insertion direction at right angles to the sealing face. In the installed position, the insertion direction is preferably in the horizontal direction. The insertion direction is preferably transverse or at right angles to the orientation of the pivoting axis.

The valve body is preferably mounted opposite the bearing point, in particular the bearing opening, of the insert element, at a further bearing point which is arranged on the drain pipe.

That is to say that the valve body is arranged partially on the insert element and partially on the further bearing point.

The actuating element is preferably a Bowden cable with a sheath and a cable supported therein, which cable acts on the valve body, wherein the sheath is mounted on the insert element. In particular, the cable acts on the free end of the lever arm of the bearing axle. Alternatively, the actuating element can also be an electric actuator, such as a motor or a servo motor, or a pneumatic actuator.

The insert element and/or the insert receptacle preferably have/has a notch for the passage of the Bowden cable. Through the notch, the Bowden cable can be guided out of the insert element in a simple manner, wherein optimal use can be made of the space conditions.

A number of further preferred optional features are now described below.

In the installed position, the valve portion preferably extends in such a way that the direction of flow runs substantially in the horizontal or at an angle of no more than 20° to the horizontal, and that, in the installed position, the sealing face is oriented substantially in the vertical or at an angle of no more than 20° to the vertical. That is to say that, in the installed position, the valve portion extends in such a way that the direction of flow runs substantially in the horizontal, and thus the barrier provided by the valve is situated in the horizontal portion. This design has the advantage that the drain pipe can be of more compact design because the two branch points extend away from said valve portion, which is in the horizontal. Moreover, the installation space can be optimized in height because the seal face is vertical and hence the valve body is moved in a horizontal direction, at least at the beginning of its movement. The beginning of the movement is interpreted to mean the disengagement of the valve body from the sealing face.

The expressions "horizontal" and "vertical" used herein refer essentially to directions at right angles or parallel to the plumbline direction. In this context, "substantially" means that the vertical may slope at a small angle of a few degrees to the plumbline direction or that the horizontal may slope at a small angle of a few degrees to the right angle with respect to the plumbline direction.

The valve body, in particular the valve flap, preferably comprises a seal element, which rests on the sealing face in the closure position. The seal element is preferably a sealing ring or a profile seal.

The sealing face is preferably an annular face extending completely around the central axis.

The sealing face is preferably provided by widening the valve portion, wherein the cross section of the valve portion is larger downstream of the sealing face than upstream of the sealing face when viewed in the direction of flow. A particularly simple arrangement of the sealing face can thereby be achieved.

Moreover, the enlargement of the cross section downstream of the sealing face ensures that the flow is not negatively affected. It is also not possible for any foreign bodies, such as hair and the like, to get caught on the sealing face.

The valve body is preferably opened in the direction of flow and closed counter to the direction of flow.

The two branch points preferably extend away from the valve portion, situated in the horizontal, counter to the plumbline direction at right angles to the central axis in the installed position. That is to say that, in the installed position, the branch points and thus also the overflow pipe extend upward away from the valve portion.

The overflow pipe preferably extends exclusively upward from the valve portion in the installed position. That is to say that, in relation to a horizontal plane extending through the central axis and situated in the horizontal in the installed position, the overflow pipe extends exclusively upward.

The branch points and the valve are preferably situated in the valve portion which is in the horizontal, allowing the required installation space for the drain assembly to be configured in a more compact way.

The pipe section adjoining the pipe inlet in the direction of flow preferably extends substantially in the horizontal or at an angle of no more than 20° to the horizontal. The pipe section adjoining the valve portion in the direction of flow extends substantially in the vertical.

The overflow pipe is preferably provided as a U-shaped pipe section. Alternatively, the overflow pipe is provided by a channel situated in the sanitary item. That is to say that the overflow pipe is part of the sanitary item. The overflow pipe is preferably connected to the two branch points by means of a mechanical plug-in connection.

Further embodiments are given in the dependent claims.

BRIEF DESCRIPTION OF THE DRAWINGS

Preferred embodiments of the invention are described below with reference to the drawings, which are intended only for explanation and should not be interpreted as restrictive. In the drawings.

DESCRIPTION OF PREFERRED EMBODIMENTS

In the figures, a drain assembly 1 for connection to a sanitary item is shown. Typically, the sanitary item is a wash stand.

Figure 9:
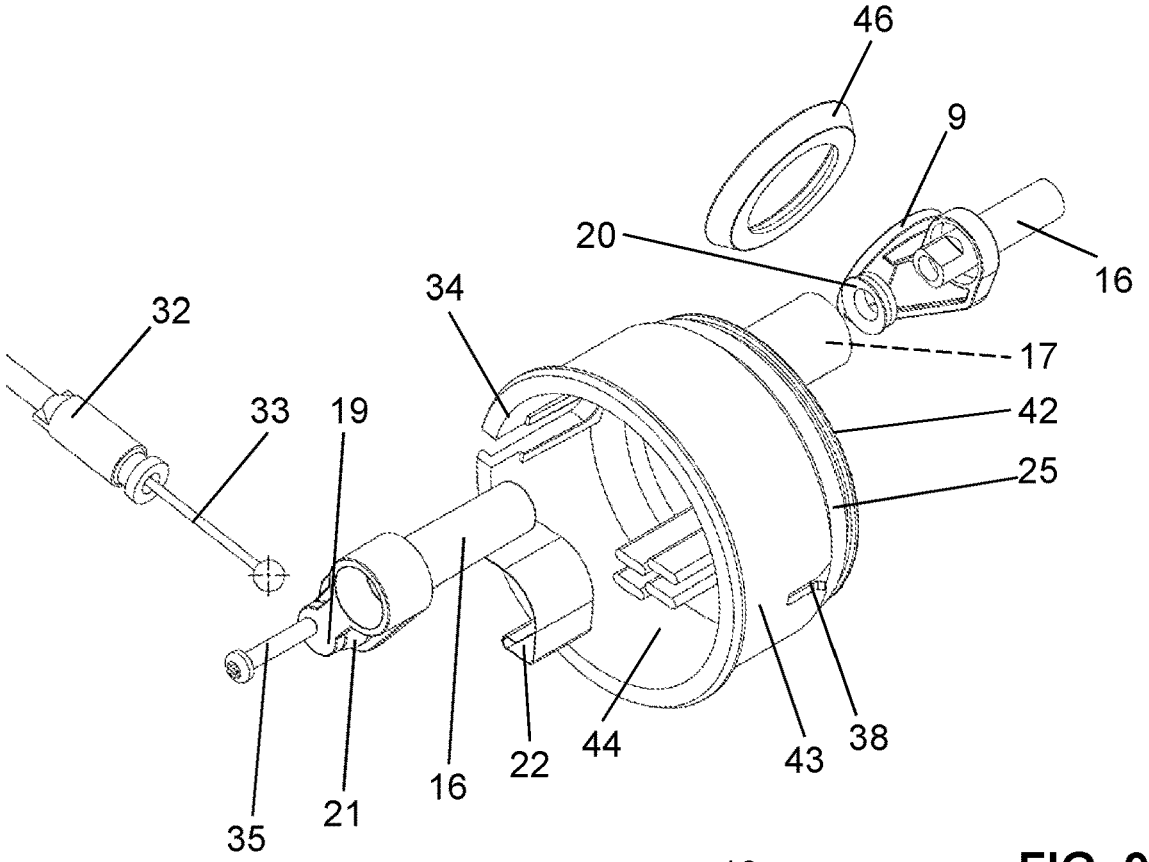
FIGS. 9/10 show detail exploded views of the drain assembly according to the preceding figures.
Figure 10:
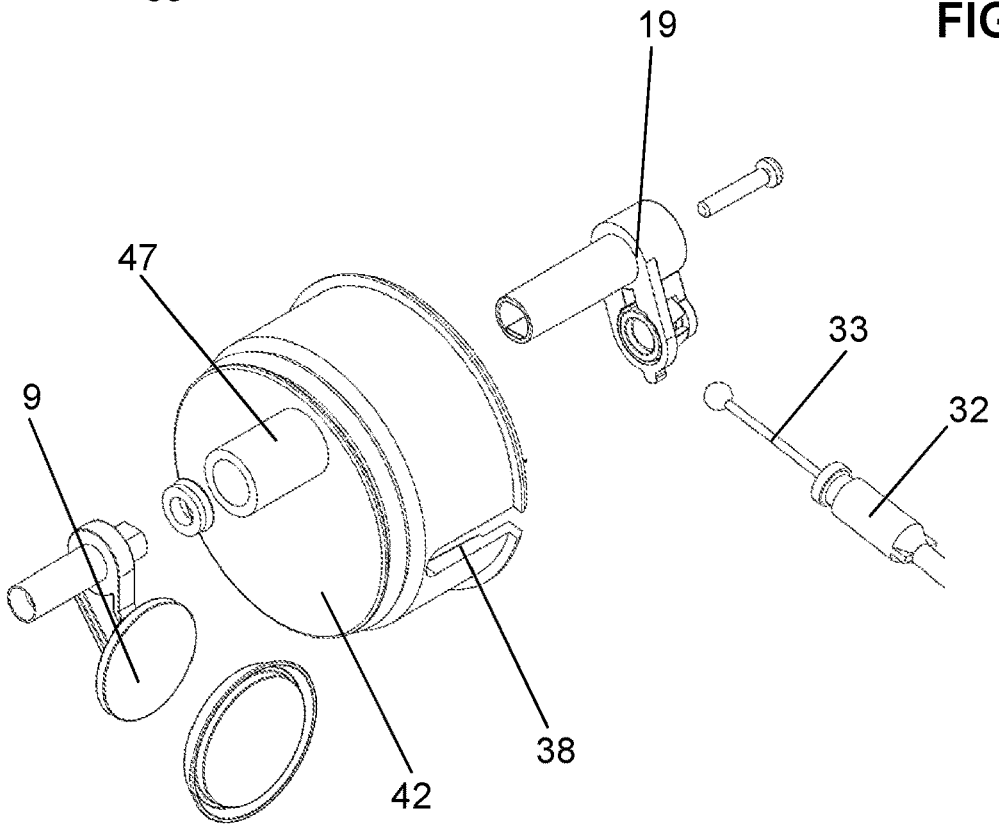
Figure 11:
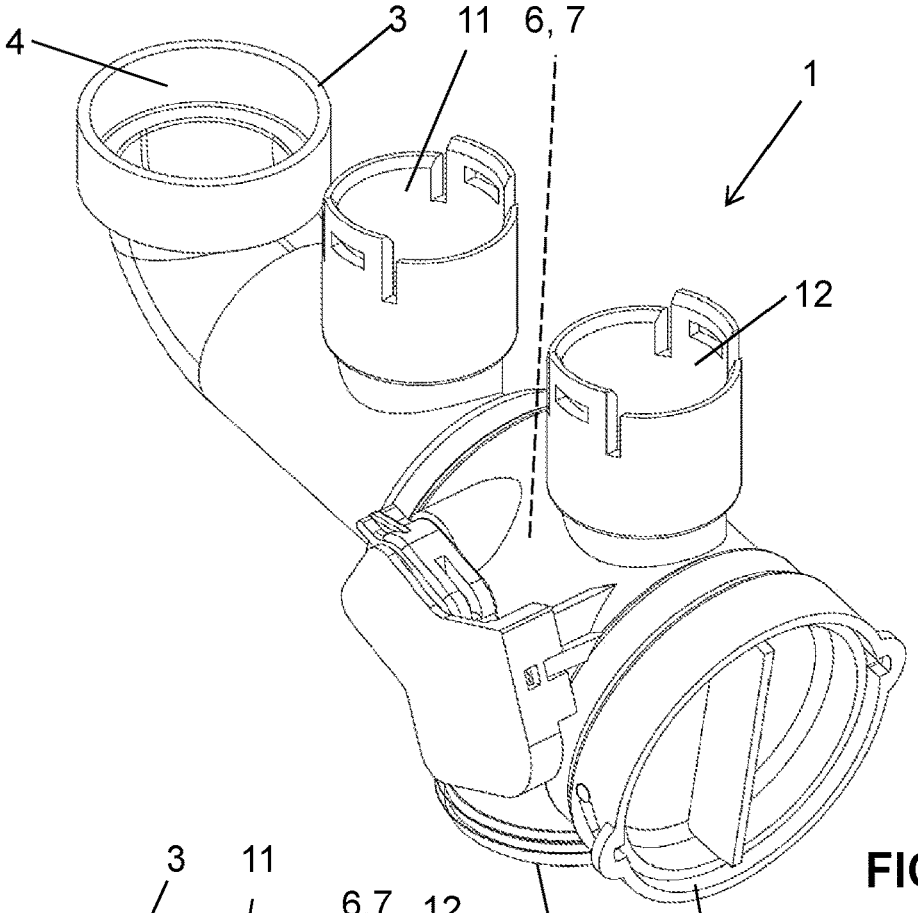
FIG. 11 shows a perspective arrangement of a drain assembly according to a second embodiment.
Figure 12:
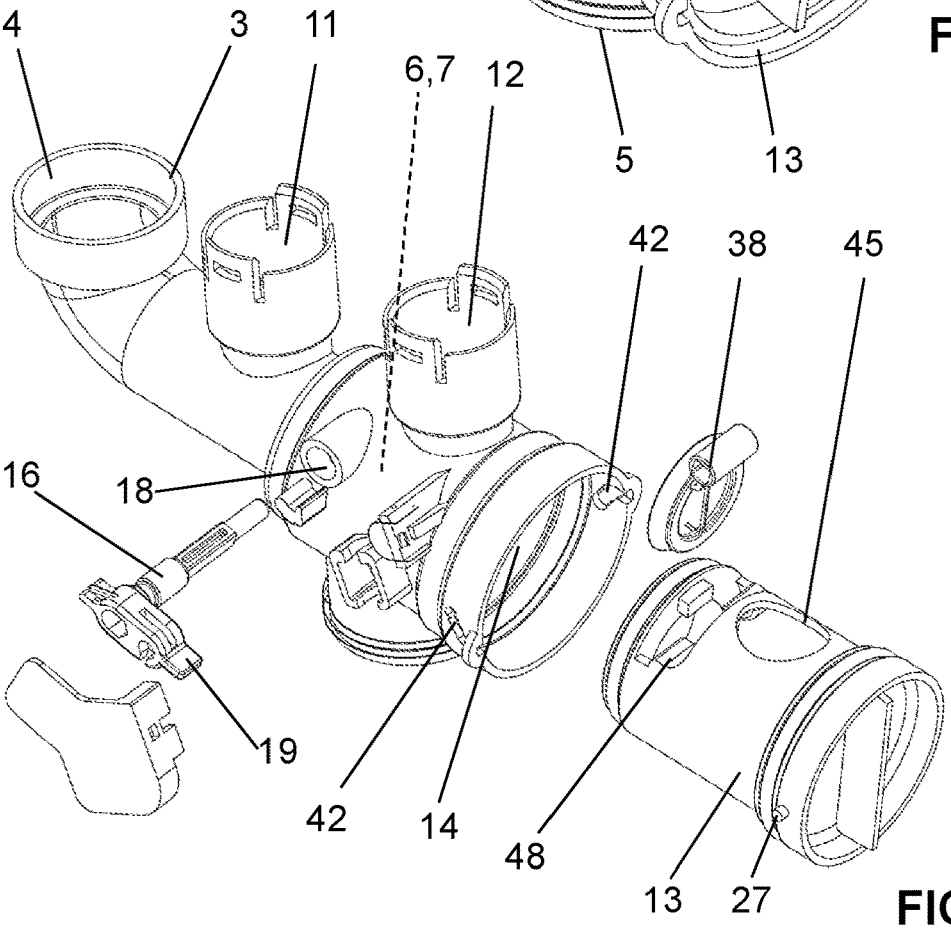
FIG. 12 shows an exploded illustration of the drain assembly according to the second embodiment.
Figure 13:
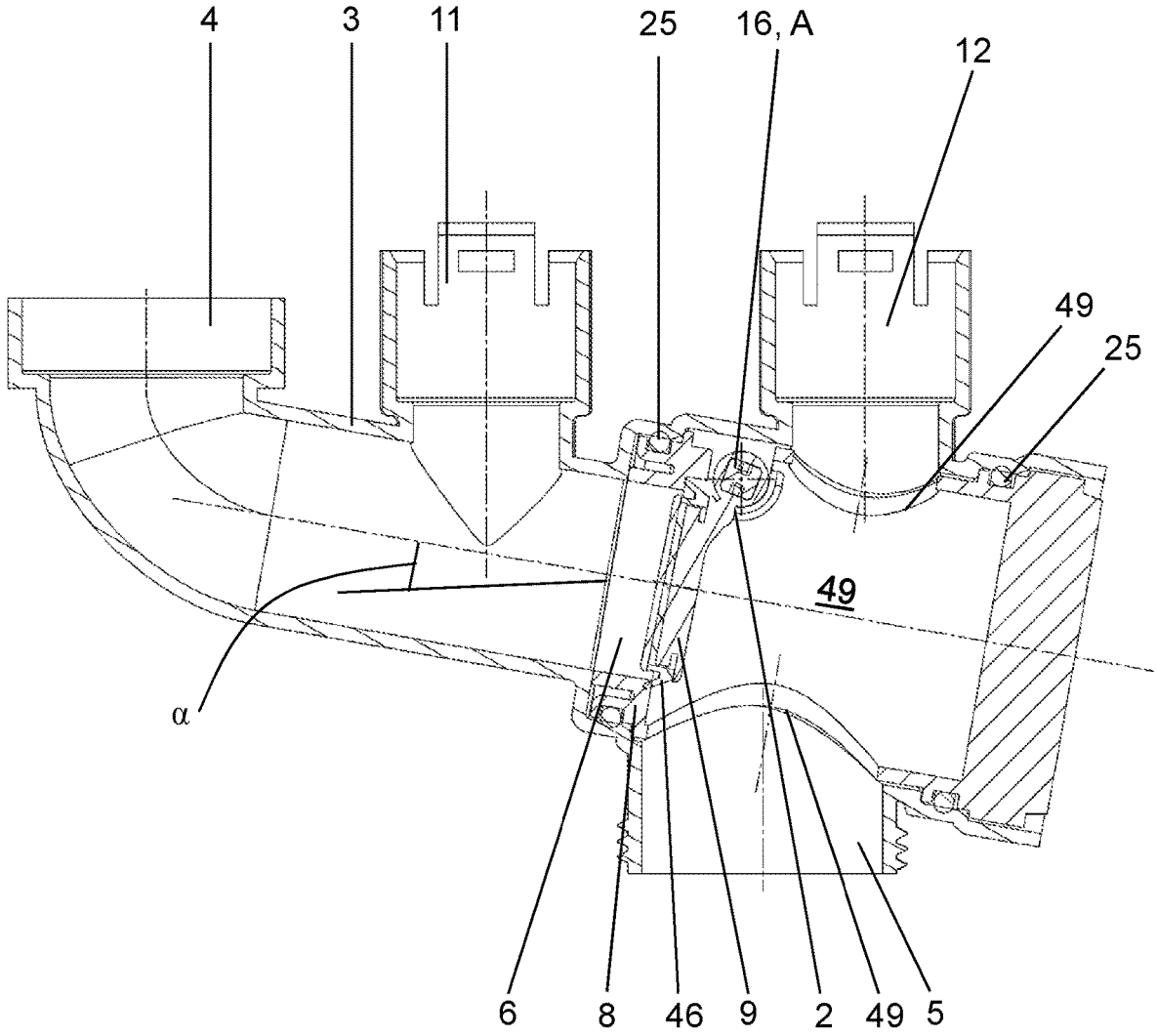
FIG. 13 shows a sectioned illustration of the drain assembly according to a second embodiment.

FIGS. 1 to 10 show a first embodiment of the drain assembly 1, and FIGS. 11 to 13 show a second embodiment of the drain assembly 1. The fundamental construction of the drain assembly 1 will now be explained below with reference to both embodiments.

The drain assembly 1 comprises a drain pipe 3 having a pipe inlet 4 and a pipe outlet 5, a valve 7 arranged in a valve portion 6 of the drain pipe 3, and an overflow pipe 10. By means of the overflow pipe 10, the valve 7 is bridged in such a way that, in the event of accidental blockage of the valve 7, the water can nevertheless drain away via the overflow pipe 10 as the water level in the sanitary item rises.

Figure 7:
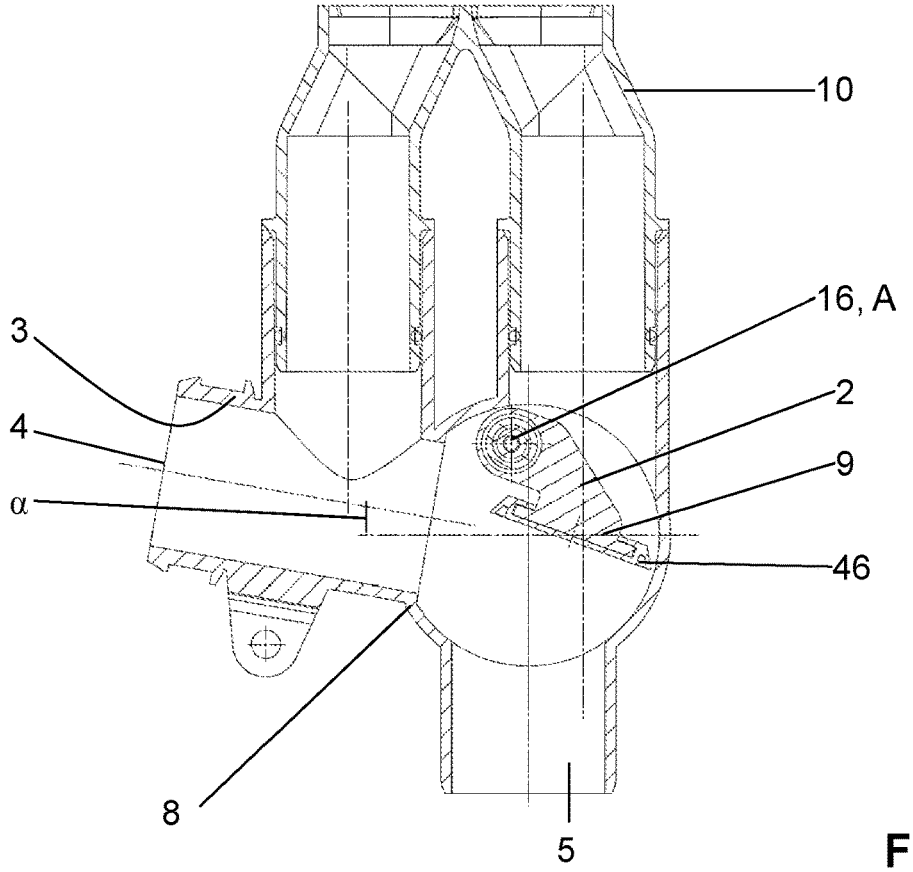
FIG. 7 shows a sectioned view of the drain assembly according to the preceding figures, wherein a valve body is in the open position.
Figure 8:
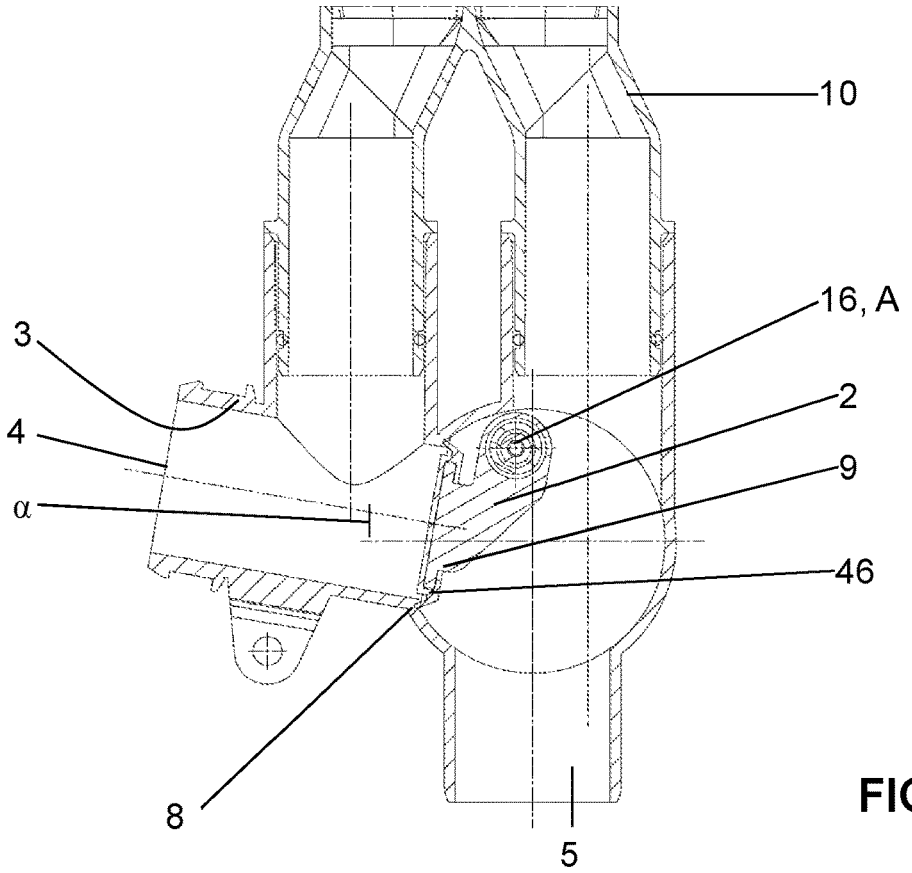
FIG. 8 shows a sectioned view of the drain assembly according to the preceding figures, wherein a valve body is in the closure position.

A valve 7 is arranged in the valve portion 6 of the drain pipe 3. The valve 7 comprises a sealing face 8 and a valve body 9, wherein the valve body 9 is movable away from the sealing face 8 from a closure position to an open position by means of an actuating element 15. The mobility of the valve body 9 is shown in more detail in the sectioned illustrations in FIGS. 7 and 8. In FIG. 7, the valve body 9 is in the open position thereof, i.e. it is at a distance from the sealing face 8, and, in FIG. 8, the valve body 9 is in the closure position thereof, i.e. the valve body 9 is resting on the sealing face 8. When the valve body 9 is in the closure position and the water in the sanitary item builds up, the water can then likewise rise in the overflow pipe 10 and correspondingly drain away via the overflow pipe 10. The valve body 9 furthermore has a seal 46, which seals off the valve body 9 relative to the sealing face 8.

The overflow pipe 10 extends from a first branch point 11 to a second branch point 12. The first branch point 11 is situated upstream of the valve 7 when viewed in the direction of flow F of the water, and the second branch point 12 is situated downstream of the valve 7 when viewed in the direction of flow F of the water. In this arrangement, the overflow pipe 10 extends away from the drain pipe 3 and, in the installed position, is oriented substantially upward counter to the plumbline direction. That is to say that, in the installed position, the overflow pipe 10 extends substantially upward counter to the plumbline direction. In both embodiments shown, the overflow pipe 10 is formed separately from the drain pipe 3, as a separate part. In this case, the overflow pipe 3 can be connected to both branch points 11, 12. This is preferably a plug-in connection of the kind that can be seen from FIGS. 2 and 3. That is to say that the overflow pipe 10 can be inserted into the two branch points 11, 12. A welded joint would also be conceivable.

Figure 1:
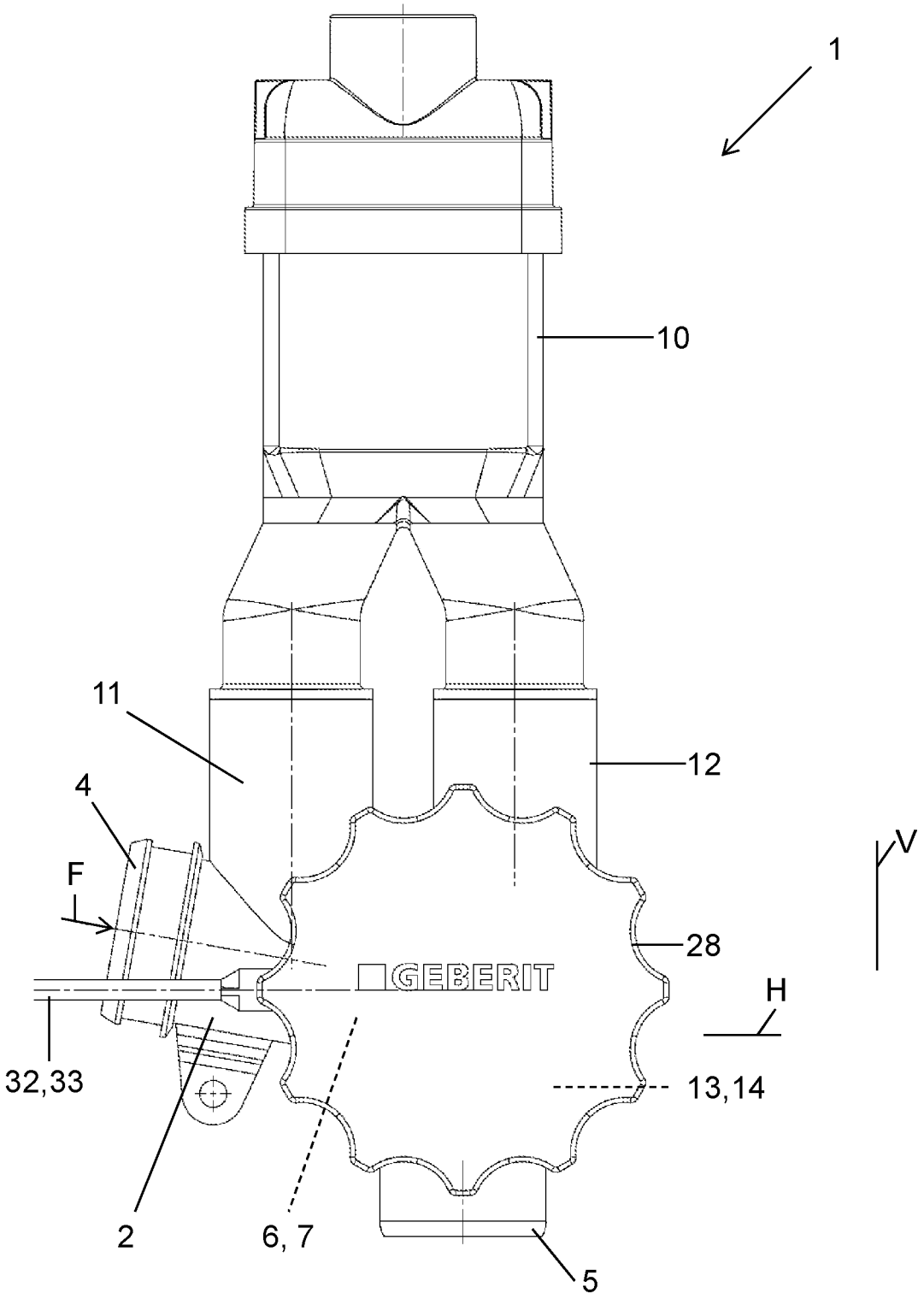
FIG. 1 shows a front view of a drain assembly according to a first embodiment.
Figure 2:
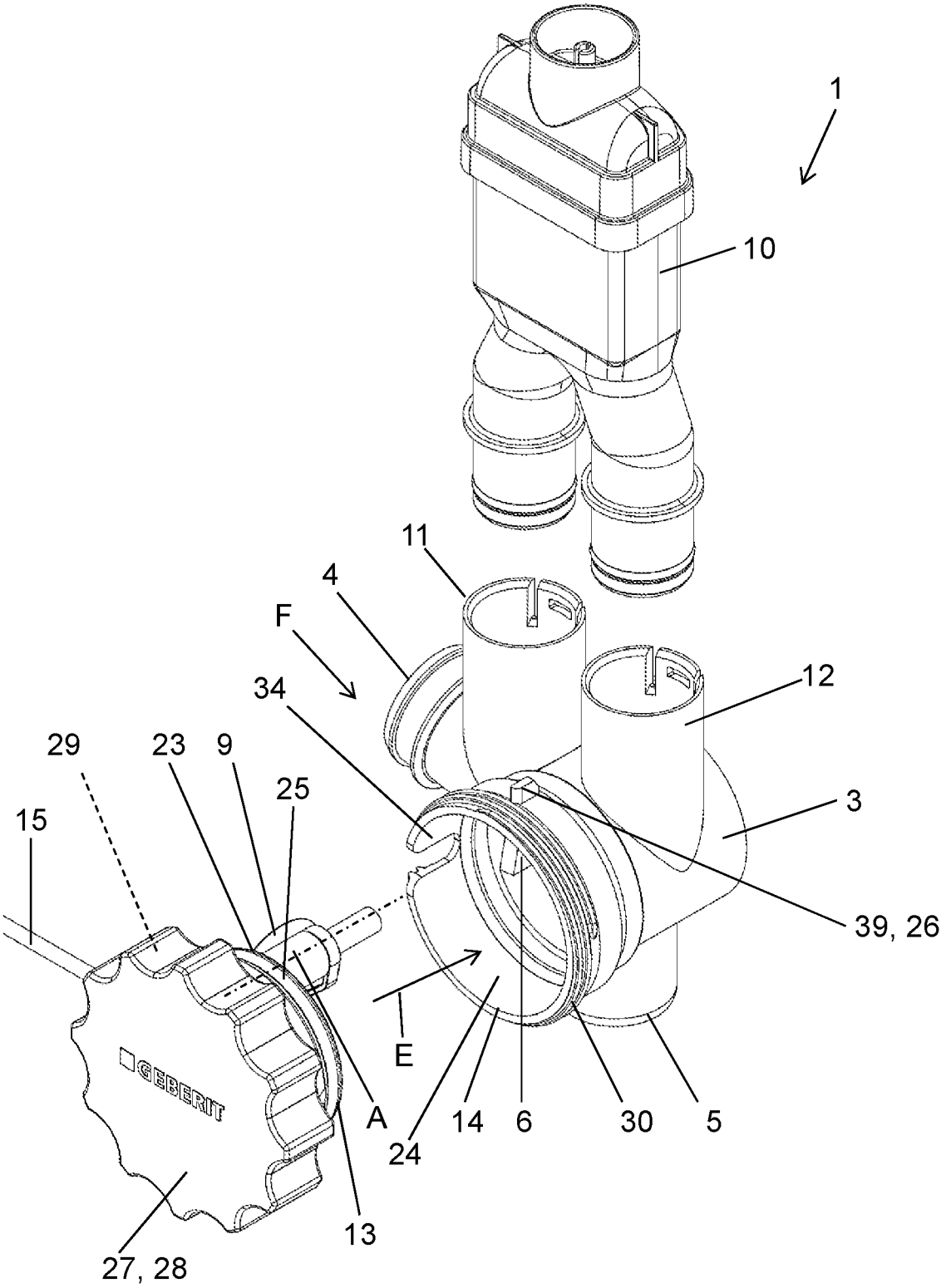
FIG. 2 shows a perspective exploded illustration of the drain assembly shown in FIG. 1.
Figure 3:
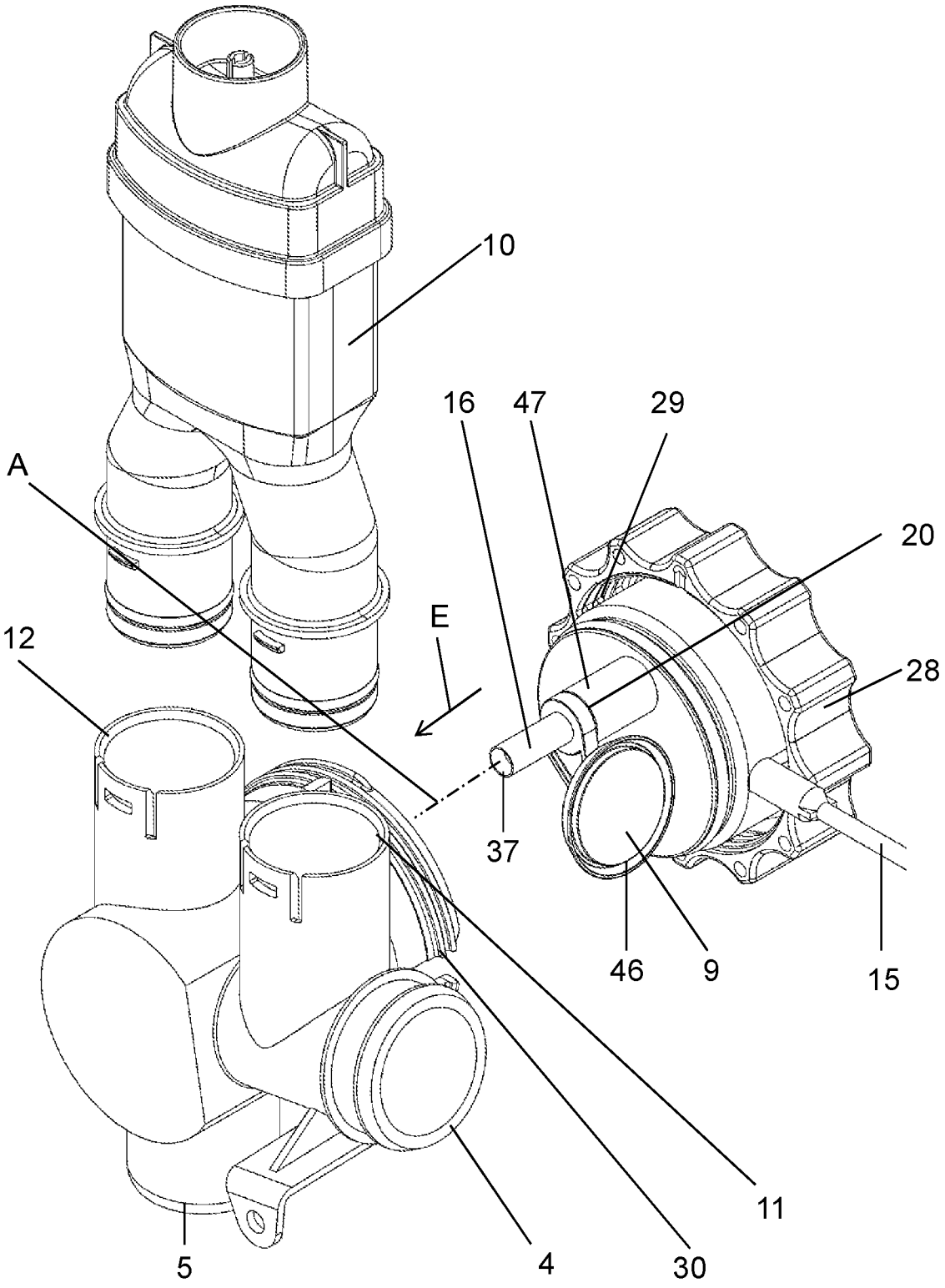
FIG. 3 shows a perspective exploded illustration of the drain assembly shown in FIGS. 1 and 2.

It can be seen from FIGS. 2 and 3 and from 11 and 12 that the valve body 9 is mounted at least partially on an insert element 13. The insert element 13 can be inserted into an insert receptacle 14. In this case, the insert receptacle 14 is part of the drain pipe 3 and projects into the drain pipe 3. By virtue of the mounting of the valve body 9 on the insert element 13, the valve body 9 can be inserted together with the insert element 13 into the drain pipe 3, into the valve portion 6. The valve body 9 can furthermore be removed from the valve portion 6 together with the insert element 13, thus enabling the valve body 9 to be exchanged, for example. The fundamental process of installation during production and the subsequent maintenance of the valve body 9 are thereby simplified.

In both embodiments, the valve body 9 is a valve flap. In this case, the valve flap 9 is designed to be pivotable relative to the sealing face 8 about a geometric pivoting axis A. That is to say that the valve flap 9 can be pivoted from the closure position into the open position by means of a pivoting motion about the geometric pivoting axis A.

In the first embodiment in accordance with FIGS. 1 to 10, the sealing face 8 is provided by the drain pipe 3. That is to say that the sealing face 8 is an integral part of the drain pipe 3. For this purpose, the drain pipe 3 has, on the inside, a corresponding offset which provides the sealing face 8. In the second embodiment in accordance with FIGS. 11 to 13, the sealing face 8 is provided by the insert element 13 itself. That is to say that the sealing face 8 is an integral part of the insert element 13.

In the first embodiment, the valve portion 6 extends in such a way in the installed position that the direction of flow F runs substantially at an angle to the horizontal H, and that, in the installed position, the sealing face 8 is oriented substantially at an angle to the vertical V. This is shown especially in FIGS. 8 and 9. The angle bears the reference sign α.

The mounting of the valve flap 13 in accordance with the first embodiment, is now explained in greater detail with reference to FIGS. 2 to 10. The valve flap 13 is mounted on a bearing axle 16. The bearing axle 16 is mounted in corresponding fashion in a bearing point 17, in this case in a bearing opening 17, on the insert element 13. Here, the bearing axle 16 extends through the bearing opening 17. According to FIG. 4, the bearing axle 16 in this preferred embodiment is of separate design. In this case, a first part of the bearing axle 16 is mounted in the bearing opening 17, and a second part is here connected to the first part by means of a screwed joint 35. In this case, the valve body 9 is correspondingly formed integrally on the second part. The two-part design of the bearing axle 16 has the advantage that a seal 20 can be arranged on a shoulder 36 on the bearing axle 16. By means of the seal 20, the bearing opening 17 is substantially sealed off, thus preventing any water from getting out through the bearing opening 17 from the side of the drain pipe 3. In other embodiments, the bearing axle 16 can also be of integral design, however.

According to the first embodiment, the valve body 9 is furthermore mounted opposite the bearing point 17 of the insert element, at a bearing point 31, which is arranged on the drain pipe 3. Here, the bearing point 31 has the form of a peg, which can engage in an opening 37 arranged in the end of the bearing axle 16. It is readily apparent from FIG. 4, which shows the exploded view, that, after the production of the screwed joint 35, the insert element 13 can be pushed into the insert receptacle 14, wherein the opening 37 is then moved in the direction of the peg 31 and correspondingly receives said peg. It then becomes apparent from FIG. 5 that the valve body 9 is mounted, on the one hand, in the bearing opening 17 and, on the other hand, opposite the bearing opening 17 on the bearing point 31. In the installed position, the bearing point 31 and the bearing opening 17 lie on the geometric pivoting axis A.

In the second embodiment, shown in FIGS. 11 to 13, the bearing axle is pivotably mounted in a bearing point 18 on the drain pipe 3. The bearing point 18 is provided by a bearing opening 18. In this case, the bearing axle 16 is pushed into the drain pipe 3 through the bearing opening 18. As it is pushed in, the bearing axle 16 in this case enters into connection with the valve flap 9. In this case, the bearing axle 16 is passed through an opening 38 in the valve flap.

In the case of both embodiments, the actual valve flap 9 is connected to the bearing axle 16 via an offset region 2.

In both embodiments, the bearing axle 16 has a free end 19. In this case, the free end 19 is the end of a lever arm 21 which projects substantially at right angles from the bearing axle 16. In this case, the free end 19 or lever arm 21 is arranged on the side of the insert element 13. The free end 19 is connected to said actuating element 15. In this case, the bearing axle 16 can be pivoted correspondingly about the geometric pivoting axis A by means of the actuating element 15. The free end 19 or lever arm 21 is situated outside the drain pipe 3. That is to say that the free end 19 of the lever arm 21 can be actuated from outside the drain pipe 3. This has the advantage that the entire actuating mechanism is situated outside the water-bearing parts.

Figure 6:
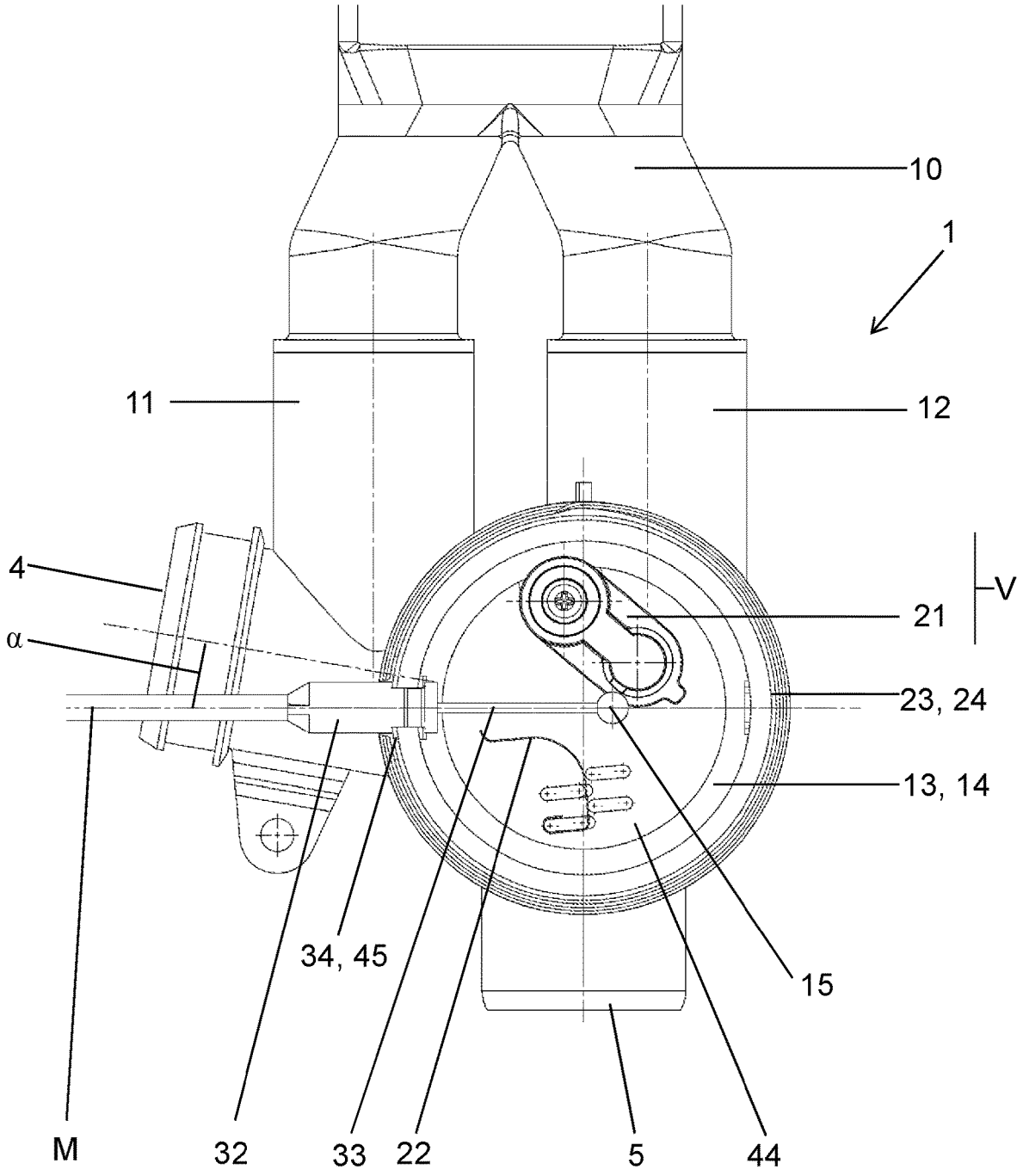
FIG. 6 shows a detail view of the drain assembly according to the preceding figures.

In both embodiments, a return element 22 is furthermore provided. Here, the return element 22 acts on the valve body 9. In particular, the return element 22 acts on the valve body 9 in such a way that said body is held in the closure position thereof. As shown by FIG. 6, the return element 22 is preferably mounted on the insert element 13. In the first embodiment, the return element 22 is a leaf spring. In the second embodiment, the return element is likewise provided by a spring means, but this is not illustrated in the figures. The return element 22 has the fundamental advantage that the valve body 9 is held in the closure position thereof, and this is advantageous particularly during assembly or disassembly. This is because it prevents the valve body 9 from colliding with the sealing face 8 as the insert element 13 is inserted into the insert receptacle 14, which could lead in some circumstances to damage to the valve body 9.

In both embodiments, the insert element 13 has a circular-cylindrical bearing portion 23. The insert receptacle 14 furthermore has a circular-cylindrical bearing receptacle portion 24. By means of the pairing of the bearing portion 23 and the bearing receptacle portion 24, the insert element 13 is mounted in the insert receptacle 14. A seal element 25 is arranged between the bearing portion 23 and the bearing receptacle portion 24.

An orientation structure 26 is preferably arranged between the insert element 13 and the insert receptacle 14, thus enabling the insert element 13 to be aligned relative to the sealing face 8 together with the valve body 9 mounted on the insert element 13. In the first embodiment, the orientation structure is a groove and ridge joint, wherein a corresponding groove 38 is arranged on the insert element 13 and correspondingly receives a ridge 39 on the insert receptacle 14. The groove 38 can be seen in FIG. 9, and the ridge 39 can be seen in FIG. 4.

In both embodiments, the insert element 13 furthermore comprises a retaining element 27. After the successful insertion of the insert element 13 into the insert receptacle 14, the insert element 13 can be fixed mechanically with respect to the drain pipe 3 by means of the retaining element 27.

In the first embodiment, the retaining element 27 is a cap 28, which is rotatably mounted on the insert element 13. Here, the cap 28 has a thread 29, which interacts with a correspondingly designed thread 30 on the drain pipe. Through a rotation of the cap 28, thread 29 engages in thread 30, and, in the process, the cap 28 can be secured with respect to the drain pipe 3. The mounting of the cap 28 on the insert element 13 is shown in more detail in FIG. 5. The cap 28 has a groove 40, which is formed circumferentially substantially around the central axis of the thread 29. A circumferentially formed ridge 41, which is arranged on the outside of the insert element 13, engages in this groove 40. The cap 28 can thereby be rotated about the central axis of the thread 29 without corresponding restriction, and this then allows the corresponding engagement on the thread 30 and the corresponding tightening of the cap 28. By virtue of the mounting, the insert element 13 is not rotated in the insert receptacle as the cap 28 is tightened. In the second embodiment, the retaining element 27 is formed integrally on the insert element 13 and essentially has the form of a bayonet catch. In this case, the retaining element 27 on the insert element 13 engages in a cam track 42, which is arranged in the region of the insert receptacle 14 on the same side as the drain pipe 3.

According to the first embodiment, the insert receptacle 14 opens into the drain pipe 3 between the first branch point 11 and the second branch point 12. Here, the insert receptacle 14 is oriented in such a way that the insert element 13 can be inserted into the insert receptacle in the direction of an insertion direction E extending transversely to the sealing face 8. In the FIGS. 2 and 3, the insertion direction E is shown by a corresponding arrow. The insertion direction E is substantially parallel to the geometric pivoting axis A.

Figure 4:
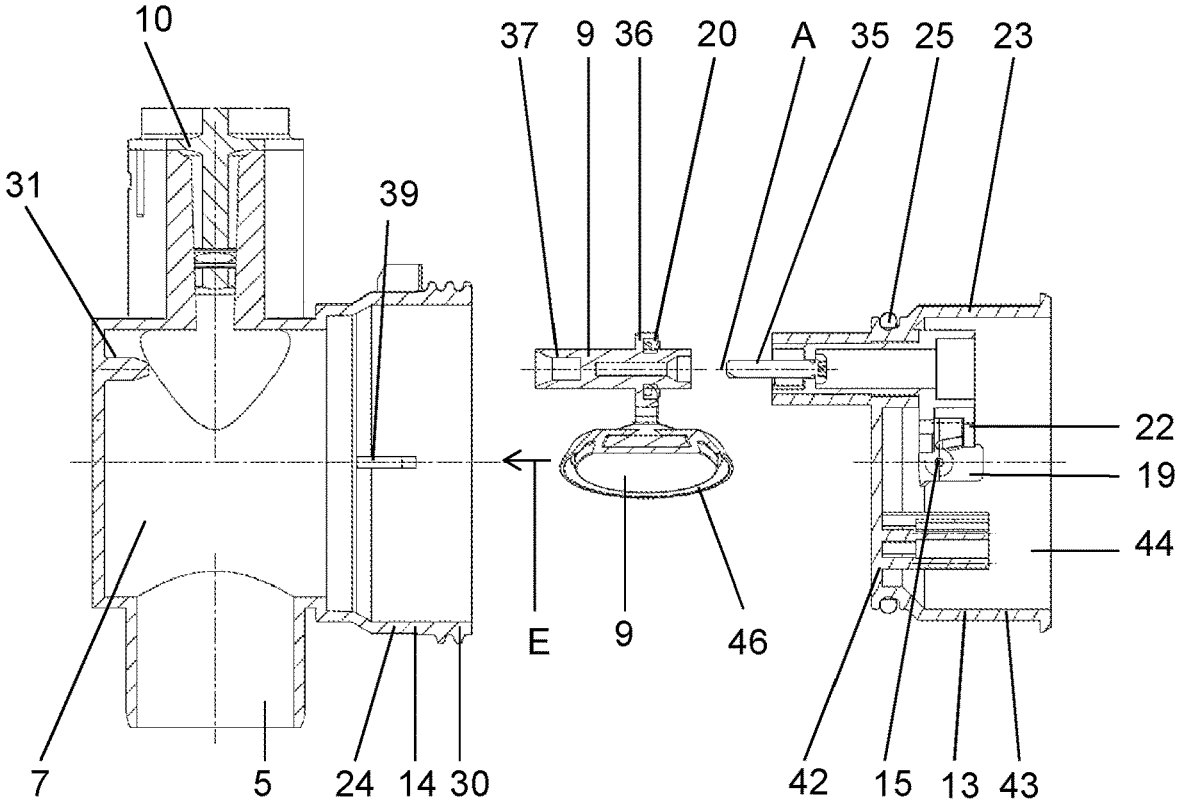
FIG. 4 shows a sectioned exploded illustration of the drain assembly according to the preceding figures.
Figure 5:
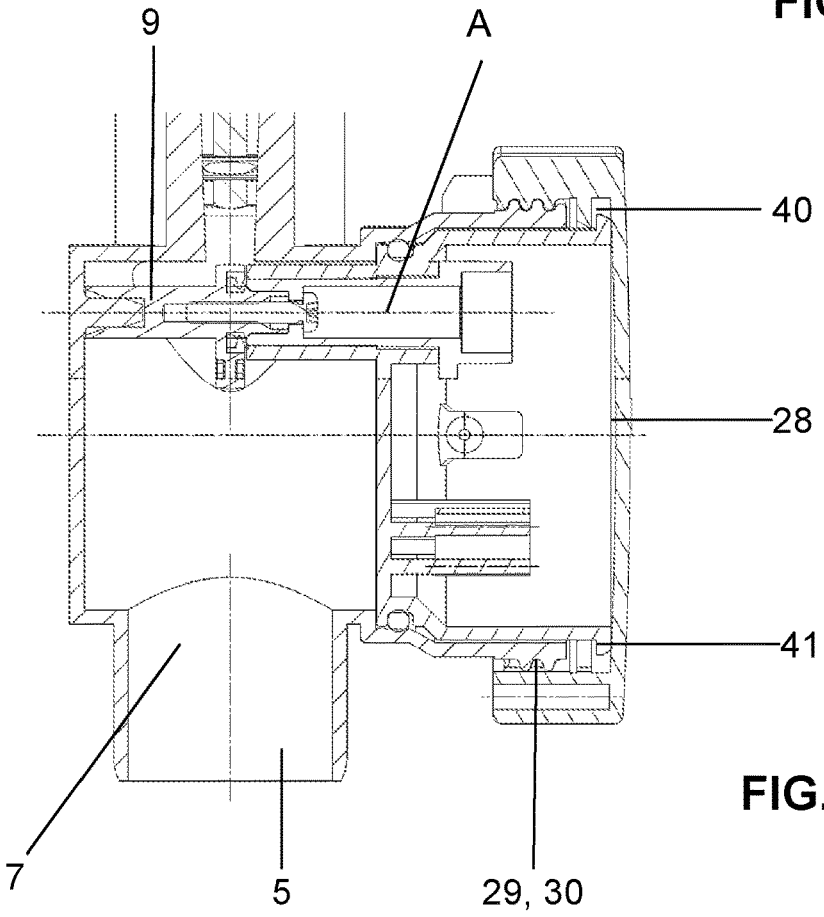
FIG. 5 shows a sectioned illustration of the drain assembly according to the preceding figures.

The specific structure of the insert element 13 is now shown by means of FIGS. 4, 9 and 10. The insert element 13 has a base 42, from which a circumferential side wall 43 extends away. The side wall 43 provides the bearing portion 23 on the outside, and the bearing point 47 is provided in the base 42. The base 42 and the side wall 43 create an interior space 44, in which the lever arm 21 and the return element 22 are situated. In the mounted position of the insert element 13, the interior space 44 is arranged at least partially in the interior of the insert receptacle 14 and is correspondingly closed here by the cap 28. The actuating element is passed to the lever arm 21 through the side wall 43. In this case, the actuating element 15 is mounted in a notch 34, which extends through the side wall 43. In the embodiment shown, the actuating element 15 is a Bowden cable with a sheath 32 and a cable 33 situated therein, wherein the cable 33 acts on the lever arm 21. The sheath 32 is mounted by means of its end region in the notch 34. Mounting the Bowden cable directly on the insert element 13 has the advantage that it is possible to create a unit which can be inserted directly into the insert receptacle 14 without a functional relationship. For passing the Bowden cable through, the insert receptacle 14 has a slot 45 in the region of the thread 30. Through this slot 45, the Bowden cable can correspondingly be passed to the outside. Here, the arrangement of the slot 45 or notch 34 makes it possible to choose a more compact construction.

In the embodiment shown, the seal element 25 which is arranged between the bearing portion 21 and the bearing receptacle portion 24 is an O-ring, which is arranged in the region of the transition between the base 42 and the side wall 43. That is to say that the seal element 25 is likewise correspondingly mounted on the insert element 13.

In the embodiment shown, the bearing opening 17 is present both in the base 42 and also in an extension 47, which extends away from the base 42. By means of the extension 47, the guiding length can be correspondingly increased. In this case, the extension 47 projects into the drain pipe 3.

The insert element according to the second embodiment is of substantially cylindrical design. In the embodiment shown, the valve body 9 is mounted loosely in a receptacle 48 on the insert element. That is to say that the valve body 9 can be inserted into the receptacle 48 before assembly. In this case, the receptacle 48 extends from the bearing portion 23 into the insert element 13. The sealing face 8, with which the valve body 9 interacts, is furthermore arranged in the region of the receptacle 48. That is to say that the sealing face 8 is here arranged on the insert element 13. The insert element 13 is inserted by means of its bearing portion 23 into the bearing receptacle portion 24. In the sectioned illustration, it is readily apparent that two seal elements 25 are provided, namely a first seal element upstream of the valve body 8 and a second seal element downstream of the valve body 8 when viewed in the direction of flow F. The insert element 13 furthermore comprises a passage 49. Here, the passage 49 comes to be situated in such a way that it lies in the region of the second branch point 12 and provides part of the drain pipe 3. Water coming from the second branch point 12 can thus be carried away through the passage 49. The water which has passed the sealing face 8 or the valve body 9 also flows into the passage 49.

LIST OF REFERENCE SIGNS

| | |
|---|---|
| 1 | drain assembly |
| 2 | offset region |
| 3 | drain pipe |
| 4 | pipe inlet |
| 5 | pipe outlet |
| 6 | valve portion |
| 7 | valve |
| 8 | sealing face |
| 9 | valve body |
| 10 | overflow pipe |
| 11 | first branch point |
| 12 | second branch point |
| 13 | insert element |
| 14 | insert receptacle |
| 15 | actuating element |
| 16 | bearing axle |
| 17 | bearing opening |
| 18 | bearing point |
| 19 | free end |
| 20 | seal |
| 21 | lever arm |
| 22 | return element |
| 23 | bearing portion |
| 24 | bearing receptacle portion |
| 25 | seal element |
| 26 | orientation structure |
| 27 | retaining element |
| 28 | cap |
| 29 | thread |
| 30 | thread |
| 31 | bearing point |
| 32 | sheath |
| 33 | cable |
| 34 | notch |
| 35 | screwed joint |
| 36 | shoulder |
| 37 | opening |
| 38 | groove |
| 39 | ridge |
| 40 | groove |
| 41 | ridge |
| 42 | base |
| 43 | side wall |
| 44 | interior space |
| 45 | slot |
| 46 | seal |
| 47 | extension |
| 48 | receptacle |
| 49 | passage |
| A | pivoting axis |
| E | insertion direction |
| F | direction of flow |
| H | horizontal |
| V | vertical |
| α | angle |

The invention claimed is:

1. A drain assembly for connection to a sanitary item, said drain assembly comprising:

a drain pipe with a pipe inlet and a pipe outlet;

a valve, which is arranged in a valve portion of the drain pipe and which valve has a sealing face and a valve body, wherein the valve body is movable away from the sealing face from a closure position to an open position by means of an actuating element; and an overflow pipe, which extends away from the drain pipe from a first branch point, which overflow pipe is arranged upstream of the valve when viewed in the direction of flow of the water, to a second branch point, which overflow pipe is arranged downstream of the valve in the direction of flow of the water, and thus bridges the valve, wherein, in the installed position, the overflow pipe extends substantially upward counter to the plumbline direction, wherein the valve body is mounted at least partially on an insert element, and wherein the drain pipe has an insert receptacle, wherein the insert element is insertable into the insert receptacle on the drain pipe, wherein the valve body is a valve flap and wherein the sealing face is provided by the drain pipe or by the insert element, and wherein the valve flap can be pivoted about a geometric pivoting axis relative to the sealing face.

2. The drain assembly as claimed in claim 1, wherein the mounting of the valve body on the insert element is such that the valve body is insertable together with the insert element into the drain pipe during an assembly process.

3. The drain assembly as claimed in claim 1, wherein the valve flap is mounted on a bearing axle, which is mounted pivotably in a bearing point on the insert element, and/or in a bearing point on the drain pipe, and wherein the bearing axle has a free end, which can be actuated by means of said actuating element.

4. The drain assembly as claimed in claim 3, wherein a seal is arranged between the bearing axle and the bearing opening; and/or wherein the free end is part of a lever arm, which projects from the bearing axle at an angle, wherein the actuating element acts on the free end; and/or wherein the free end is situated outside the drain pipe and can be actuated from outside the drain pipe.

5. The drain assembly as claimed in claim 4, wherein the said seal is arranged between the bearing axle and in the end region of the bearing opening.

6. The drain assembly as claimed in claim 4, wherein said angle is a right angle.

7. The drain assembly as claimed in claim 3, wherein the bearing point is a bearing opening.

8. The drain assembly as claimed in claim 1, wherein a return element acts on the valve body, which return element holds the valve body in the closure position thereof.

9. The drain assembly as claimed in claim 8, wherein the return element is mounted on the insert element; and/or wherein the return element is arranged outside the water-bearing region of the drain pipe.

10. The drain assembly as claimed in claim 1, wherein the insert element has a circular-cylindrical bearing portion, and wherein the insert receptacle has a circular-cylindrical bearing receptacle portion, and wherein a seal element is arranged between the bearing portion and the bearing receptacle portion.

11. The drain assembly as claimed in claim 10, wherein an orientation structure is arranged between the insert element and the insert receptacle, which structure aligns the insert element in the insert receptacle relative to the sealing face, or which structure aligns the insert element, with the valve body mounted on the insert element, relative to said sealing face.

12. The drain assembly as claimed in claim 1, wherein the insert element has a retaining element, which secures the insert element with respect to the drain pipe after the insertion of the insert element into the insert receptacle.

13. The drain assembly as claimed in claim 12, wherein the retaining element is a cap, which is mounted rotatably on the insert element and which has a thread, which interacts with a thread of corresponding design on the drain pipe; or wherein the retaining element is formed integrally on the insert element and, for example, has the form of a bayonet catch.

14. The drain assembly as claimed in claim 1, wherein the actuating element is arranged outside the water-bearing region of the drain pipe; and/or wherein the actuating element is mounted on the insert element.

15. The drain assembly as claimed in claim 1, wherein the insert receptacle opens into the drain pipe between the first branch point and the second branch point.

16. The drain assembly as claimed in claim 15, wherein the insert receptacle is oriented in such a way that the insert element can be inserted into the insert receptacle in the direction of an insertion direction transverse to the sealing face.

17. The drain assembly as claimed in claim 1, wherein the insert receptacle opens into the drain pipe between the second branch point and the pipe outlet.

18. The drain assembly as claimed in claim 1, wherein the insert receptacle is oriented in such a way that the insert element can be inserted into the insert receptacle in the direction of an insertion direction at right angles to the sealing face.

19. The drain assembly as claimed in claim 1, wherein the valve body is mounted opposite a bearing point of the insert element, at a bearing point which is arranged on the drain pipe.

20. The drain assembly as claimed in claim 1, wherein the actuating element is a Bowden cable with a sheath and a cable supported therein, which cable acts on the valve body, wherein the sheath is mounted on the insert element.

21. The drain assembly as claimed in claim 20, wherein the insert element and/or the insert receptacle have/has a notch for the passage of the Bowden cable.

22. The drain assembly as claimed in claim 1, wherein, in the installed position, the valve portion extends in such a way that the direction of flow runs substantially in the horizontal or at an angle of no more than 20° to the horizontal, and wherein, in the installed position, the sealing face is oriented substantially in the vertical or at an angle of no more than 20° to the vertical.

23. A drain assembly for connection to a sanitary item, said drain assembly comprising:

a drain pipe with a pipe inlet and a pipe outlet;

a valve, which is arranged in a valve portion of the drain pipe and which valve has a sealing face and a valve body, wherein the valve body is movable away from the sealing face from a closure position to an open position by means of an actuating element; and an overflow pipe, which extends away from the drain pipe from a first branch point, which overflow pipe is arranged upstream of the valve when viewed in the direction of flow of the water, to a second branch point, which overflow pipe is arranged downstream of the valve in the direction of flow of the water, and thus bridges the valve, wherein, in the installed position, the overflow pipe extends substantially upward counter to the plumbline direction, wherein the valve body is mounted at least partially on an insert element, and wherein the drain pipe has an insert receptacle, wherein the insert element can be inserted into the insert receptacle on the drain pipe, wherein, in the installed position, the valve portion extends in such a way that the direction of flow runs substantially in the horizontal or at an angle of no more than 20° to the horizontal, and wherein, in the installed position, the sealing face is oriented substantially in the vertical or at an angle of no more than 20° to the vertical.

24. The drain assembly as claimed in claim 23, wherein the mounting of the valve body on the insert element is such that the valve body is insertable together with the insert element into the drain pipe during an assembly process.

25. The drain assembly as claimed in claim 23, wherein the valve body is a valve flap and wherein the sealing face is provided by the drain pipe or by the insert element, and wherein the valve flap can be pivoted about a geometric pivoting axis relative to the sealing face.

26. The drain assembly as claimed in claim 23, wherein the valve flap is mounted on a bearing axle, which is mounted pivotably in a bearing point on the insert element, and/or in a bearing point on the drain pipe, and wherein the bearing axle has a free end, which can be actuated by means of said actuating element.

27. The drain assembly as claimed in claim 26, wherein a seal is arranged between the bearing axle and the bearing opening; and/or wherein the free end is part of a lever arm, which projects from the bearing axle at an angle, wherein the actuating element acts on the free end; and/or wherein the free end is situated outside the drain pipe and can be actuated from outside the drain pipe.

28. The drain assembly as claimed in claim 27, wherein the said seal is arranged between the bearing axle and in the end region of the bearing opening.

29. The drain assembly as claimed in claim 27, wherein said angle is a right angle.

30. The drain assembly as claimed in claim 26, wherein the bearing point is a bearing opening.

31. The drain assembly as claimed in claim 23, wherein a return element acts on the valve body, which return element holds the valve body in the closure position thereof.

32. The drain assembly as claimed in claim 31, wherein the return element is mounted on the insert element; and/or wherein the return element is arranged outside the water-bearing region of the drain pipe.

33. The drain assembly as claimed in claim 23, wherein the insert element has a circular-cylindrical bearing portion, and wherein the insert receptacle has a circular-cylindrical bearing receptacle portion, and wherein a seal element is arranged between the bearing portion and the bearing receptacle portion.

34. The drain assembly as claimed in claim 33, wherein an orientation structure is arranged between the insert element and the insert receptacle, which structure aligns the insert element in the insert receptacle relative to the sealing face, or which structure aligns the insert element, with the valve body mounted on the insert element, relative to said sealing face.

35. The drain assembly as claimed in claim 23, wherein the insert element has a retaining element, which secures the insert element with respect to the drain pipe after the insertion of the insert element into the insert receptacle.

36. The drain assembly as claimed in claim 35, wherein the retaining element is a cap, which is mounted rotatably on the insert element and which has a thread, which interacts with a thread of corresponding design on the drain pipe; or wherein the retaining element is formed integrally on the insert element and, for example, has the form of a bayonet catch.

37. The drain assembly as claimed in claim 23, wherein the actuating element is arranged outside the water-bearing region of the drain pipe; and/or wherein the actuating element is mounted on the insert element.

38. The drain assembly as claimed in claim 23, wherein the insert receptacle opens into the drain pipe between the first branch point and the second branch point.

39. The drain assembly as claimed in claim 38, wherein the insert receptacle is oriented in such a way that the insert element can be inserted into the insert receptacle in the direction of an insertion direction transverse to the sealing face.

40. The drain assembly as claimed in claim 23, wherein the insert receptacle opens into the drain pipe between the second branch point and the pipe outlet.

41. The drain assembly as claimed in claim 23, wherein the insert receptacle is oriented in such a way that the insert element can be inserted into the insert receptacle in the direction of an insertion direction at right angles to the sealing face.

42. The drain assembly as claimed in claim 23, wherein the valve body is mounted opposite a bearing point of the insert element, at a bearing point which is arranged on the drain pipe.

43. The drain assembly as claimed in claim 23, wherein the actuating element is a Bowden cable with a sheath and a cable supported therein, which cable acts on the valve body, wherein the sheath is mounted on the insert element.

44. The drain assembly as claimed in claim 43, wherein the insert element and/or the insert receptacle have/has a notch for the passage of the Bowden cable.

45. The drain assembly as claimed in claim 23, wherein, in the installed position, the valve portion extends in such a way that the direction of flow runs substantially in the horizontal or at an angle of no more than 20° to the horizontal, and wherein, in the installed position, the sealing face is oriented substantially in the vertical or at an angle of no more than 20° to the vertical.

* * * * *